US008489001B2

(12) United States Patent
Kimura

(10) Patent No.: US 8,489,001 B2
(45) Date of Patent: Jul. 16, 2013

(54) POWDER CONVEYANCE DEVICE AND IMAGE FORMING APPARATUS USING SAME

(75) Inventor: Noriyuki Kimura, Kawasaki (JP)

(73) Assignee: Ricoh Company, Limited, Tokyo (JP)

( * ) Notice: Subject to any disclaimer, the term of this patent is extended or adjusted under 35 U.S.C. 154(b) by 340 days.

(21) Appl. No.: 12/879,336

(22) Filed: Sep. 10, 2010

(65) Prior Publication Data

US 2011/0081168 A1 Apr. 7, 2011

(30) Foreign Application Priority Data

Oct. 2, 2009 (JP) ..... 2009-230398
May 21, 2010 (JP) ..... 2010-117168

(51) Int. Cl.
*G03G 15/08* (2006.01)

(52) U.S. Cl.
USPC ..... 399/258; 399/119; 399/120; 399/255; 399/256

(58) Field of Classification Search
USPC ..... 399/119, 120, 255, 256, 258
See application file for complete search history.

(56) References Cited

U.S. PATENT DOCUMENTS 5,331,390 A 7/1994 Kimura et al.
5,465,139 A 11/1995 Kimura et al.
5,512,984 A 4/1996 Kimura et al.
5,537,197 A 7/1996 Fujishiro et al.
5,565,973 A 10/1996 Fujishiro et al.
5,583,630 A 12/1996 Kimura et al.
5,655,193 A 8/1997 Fujishiro et al.
6,192,211 B1 2/2001 Kimura
2004/0265011 A1* 12/2004 Tsuda et al. ..... 399/260
2009/0022504 A1 1/2009 Kuwabara et al.
2011/0222871 A1 9/2011 Suzuki et al.

FOREIGN PATENT DOCUMENTS

JP 8-30097 2/1996
JP 2005-24665 1/2005
JP 4294464 4/2009

OTHER PUBLICATIONS

U.S. Appl. No. 08/050,610, filed Apr. 22, 1993, Noriyuki Kimura.

* cited by examiner

*Primary Examiner* — Ryan Walsh
(74) *Attorney, Agent, or Firm* — Oblon, Spivak, McClelland, Maier & Neustadt, L.L.P.

(57) ABSTRACT

A powder conveyance device includes a powder container, a conveyance pipe extending downward and including first, second, and third conveyance portions disposed in that order, a first bent portion connecting together the first and second conveyance portions, bent in a direction to increase a horizontal gradient of the second conveyance portion from that of the first conveyance portion, and a second bent portion connecting together the second and third conveyance portions, bent in a direction to reduce a horizontal gradient of the third conveyance portion from that of the second conveyance portion, a powder conveyance member disposed inside the conveyance pipe, and a first powder regulator movably disposed inside the third conveyance portion of the conveyance pipe, to restrict an amount of powder discharged through the discharge port by varying a cross sectional area of a space present above a discharge port in the conveyance pipe.

15 Claims, 9 Drawing Sheets

POWDER CONVEYANCE DEVICE AND IMAGE FORMING APPARATUS USING SAME

CROSS-REFERENCE TO RELATED APPLICATIONS

This patent specification is based on and claims priority from Japanese Patent Application Nos. 2009-230398, filed on Oct. 2, 2009, and 2010-117168 filed on May 21, 2010 in the Japan Patent Office, which are hereby incorporated by reference herein in their entirety.

BACKGROUND OF THE INVENTION

1. Field of the Invention

The present invention generally relates to a powder conveyance device to convey powder such as toner from a powder container to a destination and an image forming apparatus such as a copier, a printer, a facsimile machine, a plotter, or a multifunction machine capable of at least two of these functions that includes the power conveyance device.

2. Discussion of the Background Art

In general, electrophotographic image forming apparatuses such as copiers, printers, facsimile machines, or multifunction machines including at least two of these functions include a development device to develop latent images formed on an image carrier, and a toner conveyance device to convey powdered toner to the development device from a replaceable toner bottle.

Such toner conveyance devices typically include a toner container, a toner discharge member to discharge toner from the toner container, and conveyance means such as a conveyance pipe that connects the toner container to the development device. The toner discharge member is operated as required to discharge toner from the toner container to the conveyance pipe, and the toner is supplied through the conveyance pipe to the development device.

In image forming apparatuses using such a toner conveyance device, when the toner container is positioned lower than the development device, powdered toner discharged to the conveyance pipe must be conveyed upward against the force of gravity to the development device, an arrangement that has the effect of reducing efficiency in toner conveyance. Additionally, such a configuration can increase the possibility of clogging of the conveyance pipe with toner. Therefore, the toner container is generally disposed above the development device so that toner can be transported downward in the direction of gravity.

For example, JP-H08-30097 discloses such a toner conveyance device for transporting toner in the direction of gravity. This toner conveyance device includes a toner box serving as the toner container, the conveyance pipe, and the toner discharge member that discharges toner from the toner box to the conveyance pipe. Toner drops under gravity through the conveyance pipe to the development device.

However, in this toner conveyance device, it is possible that the toner discharged from the toner box accumulates in the conveyance pipe and a relatively large amount of toner might flow to the development device at one time, a phenomenon hereinafter referred to "uncontrolled flow of toner". For example, if toner flows uncontrollably into development devices using two-component developer consisting essentially of toner and magnetic carrier, it is difficult to adjust the toner concentration in the two-component developer properly. Additionally, in development devices using one-component developer consisting essentially of only toner, if a relatively large amount of toner flows to the development device at one time, the proportion of toner particles having insufficient electrical charge in the developer increases suddenly, which can cause image failure in which insufficiently charged toner particles adhere to a non-image area of the image carrier. Occurrence of uncontrolled flow of toner may be prevented by disposing the toner box and the development device relatively close to each other, thereby reducing the length of the conveyance pipe because the amount of toner accumulated in the conveyance pipe can be reduced accordingly. However, such limitations reduce design flexibility in layout in the image forming apparatus.

In view of the foregoing, JP-2005-24665-A proposes using a coil to transport the toner and a bar-shaped powder conveyance regulator that restricts passage of toner inside the conveyance pipe, both disposed inside the conveyance pipe, in order to keep the amount of supplied toner constant without sacrificing flexibility in the layout.

However, although effective for reliable toner supply to some extent, this approach has several drawbacks. For example, in multicolor image forming apparatuses, when fluidity (degree of agglomeration) of toner is different among the different color toners or limitations in layout cause differences in the configuration (shape, length, etc.,) of the toner conveyance path for the respective color toners, the amount of toner supplied to the development device (hereinafter "toner supply amount") may be different among the different color toners or become insufficient because of the powder conveyance regulator.

Moreover, in modification of existing image forming apparatuses to achieve higher image quality, if the type of toner used therein is changed, similar problems may arise due to differences in fluidity (degree of agglomeration) between the toner used in the existing apparatus and that used in the modified apparatus. In this case, it is preferable that a dedicated toner conveyance regulator be designed for each color, for each toner conveyance path, and for each modification of the apparatus.

In view of the foregoing, the inventor of the present invention recognizes that there is a need for a powder conveyance device capable of adjusting the toner supply amount in accordance with conditions such as differences in fluidity of powder (toner), the length of the conveyance path, etc.

SUMMARY OF THE INVENTION

In view of the foregoing, in one illustrative embodiment of the present invention provides a powder conveyance device to transport powder to a destination.

The powder conveyance device includes a powder container for containing powder, a conveyance pipe extending downward from the powder container, a powder conveyance member disposed inside the conveyance pipe, to transport the powder toward the destination downward, and a first powder regulator movably disposed adjacent to the discharge port.

The conveyance pipe includes a first conveyance portion that communicates with the powder container and includes a supply port through which the powder enters in the conveyance pipe, a second conveyance portion extending downward, disposed downstream from the first conveyance portion in a powder conveyance direction in which the powder is transported from the powder container to the destination, a first bent portion connecting the first conveyance portion to the second conveyance portion, a third conveyance portion that is disposed downstream from the second conveyance portion in the powder conveyance direction and includes a discharge port through which the powder is discharged from the conveyance pipe, and a second bent portion connecting the second conveyance portion to the third conveyance portion. The first bent portion is bent in a direction to increase a horizontal gradient of the second conveyance portion from a horizontal gradient of the first conveyance portion, and the second bent portion is bent in a direction to reduce a horizontal gradient of the third conveyance portion from the horizontal gradient of the second conveyance portion. The first powder regulator is disposed inside the third conveyance portion of the conveyance pipe and restricts an amount of powder discharged through the discharge port by varying a cross sectional area of a space present between the discharge port formed in the third conveyance portion and an outer circumferential surface of the first powder regulator facing the discharge port with a change in position of the first powder regulator.

In another illustrative embodiment of the present invention, an image forming apparatus includes an image carrier on which an electrostatic latent image is formed, a development device to develop the latent image with toner into a toner image, a toner bottle for containing toner, and the above-described powder conveyance device to transport powdered toner.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
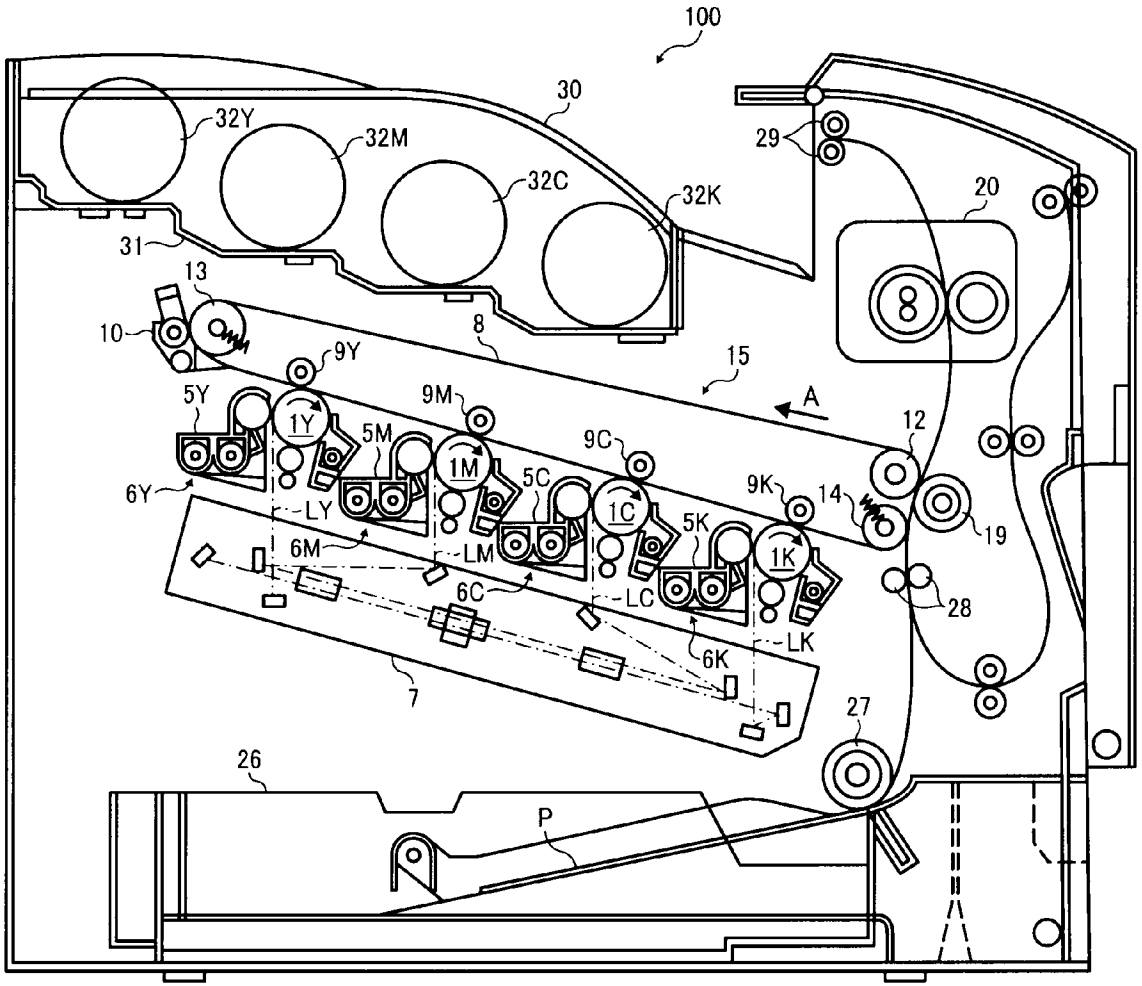
FIG. 1 is a schematic diagram of an image forming apparatus according to an illustrative embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an electrophotographic image forming apparatus according to an illustrative embodiment of the present invention is described. The image forming apparatus in the present embodiment is a printer and hereinafter referred to as a printer.

Figure 2:
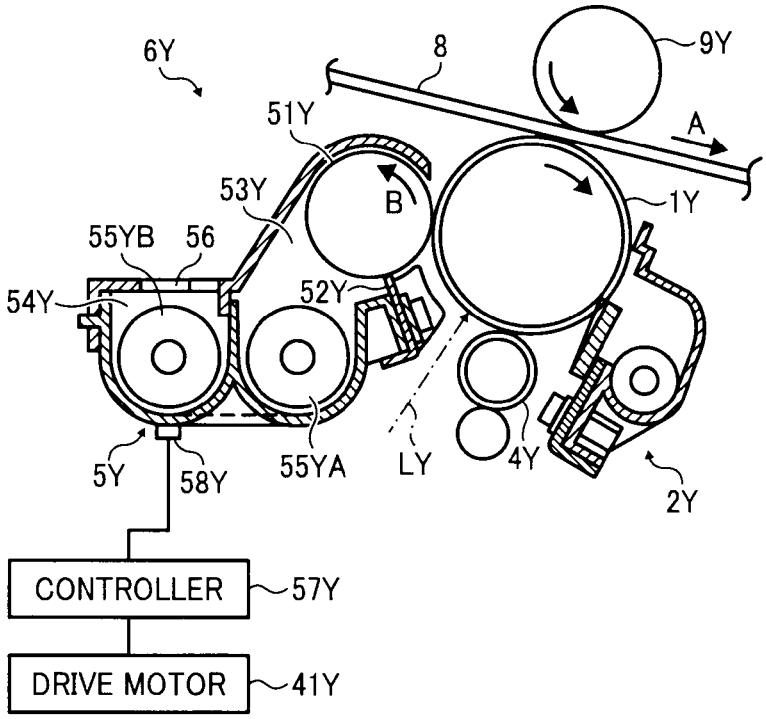
FIG. 2 is a cross-sectional diagram that schematically illustrates a configuration of a process cartridge for yellow included in the image forming apparatus shown in FIG. 1.

FIG. 1 is a schematic diagram of the printer according to the present embodiment. FIG. 2 is a cross-sectional diagram that schematically illustrates a configuration of a process cartridge for yellow.

Referring to FIG. 1, a printer 100 includes four process cartridges 6Y, 6M, 6C, and 6K for forming yellow, magenta, cyan, and black toner images, respectively. It is to be noted that the subscripts Y, M, C, and K attached to the end of each reference numeral indicate only that components indicated thereby are used for forming yellow, magenta, cyan, and black images, respectively, and hereinafter may be omitted when color discrimination is not necessary. The process cartridges 6Y, 6M, 6C, and 6K have a similar configuration except that the color of the toner used therein is different and are replaced when their operational lives expire. For example, as shown in FIG. 2, the process cartridge 6Y for yellow includes a drum-shaped photoconductor 1Y, and a drum cleaner 2Y, a discharger (not shown), a charger 4Y, and a development device 5Y are provided around the photoconductor 1Y, held in a common unit casing together with the photoconductor 1Y.

The image forming unit 6Y is removably insertable to a main body of the printer 100, and consumables can be replaced at once when the process cartridge 6Y is pulled out from the printer 100. It is to be noted that it is not necessary that all of the drum cleaner 2Y, the discharger (not shown), the charger 4Y, and the development device 5Y are held in the common unit casing together with the photoconductor 1Y as in the present embodiment, alternatively, the photoconductor 1Y and at least one of the cleaner 2Y, the discharger (not shown), the charger 4Y, and the development device 5Y may be held in the common unit casing.

A stack portion 30 is formed on an upper surface of the printer 100, and a bottle container 31 is provided between the stack portion 30 and an intermediate transfer unit 15 disposed beneath the stack portion 30. The bottle container 31 houses toner bottles 32Y, 32M, 32C, and 32K for containing yellow, magenta, cyan, and black toners, respectively. In the printer 100 according to the present embodiment, the toner bottles 32 are removably attachable to the main body of the printer 100 independently of the process cartridges 6, that is, the toner bottles 32 are replaceable independently of the process cartridges 6. This configuration can facilitate replacement of the toner bottles 32. The respective toner bottles 32 are installed in the bottle container 31 from above. The yellow, magenta, cyan, and black toners in the toner bottles 32 are respectively supplied by toner conveyance devices 40 (shown in FIG. 5) to the development devices 5 in the process cartridges 6 as required. It is to be noted that, although each toner bottle 32 contains only toner particles in the present embodiment, alternatively, each toner bottle 32 may contain developer in which carrier particles and toner particles are mixed together.

An exposure unit 7 is provided beneath the process cartridges 6 in FIG. 1. The exposure unit 7 serves as a latent image forming unit and directs laser beams LY, LM, LC, and LK to the photoconductors 1Y, 1M, 1C, and 1K in the process cartridges 6Y, 6M, 6C, and 6K, respectively, according to image data, thereby forming electrostatic latent images thereon. More specifically, although not shown in the drawings, the exposure unit 7 includes multiple optical lenses, multiple mirrors, and a polygon mirror that is rotated by a motor and directs the laser beams LY, LM, LC, and LK emitted from respective light sources to the respective photoconductors 1 via the multiple optical lenses and mirrors while deflecting the laser beams LY, LM, LC, and LK with the polygon mirror.

A sheet feeder including a sheet cassette 26, a feed roller 27 incorporated in the sheet cassette 27, and a pair of registration rollers 28 is provided beneath the exposure unit 7 in FIG. 1. The sheet feeder is for conveying sheets P of recording media (transfer sheets) from the sheet cassette 26 to a secondary-transfer nip. The sheet cassette 26 contains piled multiple sheets P of recording media, and the feed roller 27 is in contact with the sheet P on the top therein. When the feed roller 27 is rotated counterclockwise in FIG. 1 by a driving unit, not shown, the sheet P on the top is fed to the pair of registration rollers 28. The pair of registration rollers 28 stops rotating immediately after the sheet P is sandwiched therebetween and then forwards the sheet P to the secondary-transfer nip timed to coincide with image formation.

The intermediate transfer unit 15 is disposed above the process cartridges 6 and includes an intermediate transfer belt 8 that is stretched by multiple rollers and is rotated endlessly. The intermediate transfer unit 15 includes four primary-transfer bias rollers 9Y, 8M, 9C, and 9K, a cleaning unit 10, and the like in addition to the intermediate transfer belt 8. The intermediate transfer unit 15 further includes a secondary-transfer backup roller 12, a cleaning backup roller 13, and a tension roller 14, around which the intermediate transfer belt 8 is stretched, and the intermediate transfer belt 8 is rotated counterclockwise in FIG. 1 as at least one of the three rollers rotates. The four primary-transfer bias rollers 9 are configured to press against the respective photoconductors 1 via the intermediate transfer belt 8, and four contact portions between the primary-transfer bias rollers 9 and the corresponding photoconductors 1 are hereinafter referred to as primary-transfer nips.

Each primary-transfer bias roller 9 applies a transfer bias whose polarity (for example, positive) is opposite that of toner to a back surface (inside the loop) of the intermediate transfer belt 8. The above-described rollers are grounded electrically except the primary-transfer bias rollers 9. Image formation in the process cartridge 6Y is described below with reference to FIG. 2. Referring to FIG. 2, the charger 4Y uniformly charges a surface of the photoconductor 1Y that is rotated clockwise in FIG. 2 by a driving unit, not shown. The exposure unit 7 (shown in FIG. 1) directs the laser beam LY onto the surface of the photoconductor 1Y charged uniformly, thus forming an electrostatic latent image for yellow thereon. The development device 5Y develops the electrostatic latent image with yellow toner into a yellow toner image. Similarly, magenta, cyan, and black toner images are formed on the photoconductors 1M, 1C, and 1K in the process cartridges 6M, 6C, and 6K, respectively. Subsequently, referring to FIG. 1, as the intermediate transfer belt 8 rotating in arrow A shown in FIG. 1 passes the four primary-transfer nips sequentially, the yellow, magenta, cyan, and black toner images are transferred from the photoconductors 1Y, 1M, 1C, and 1K and superimposed one on another on the intermediate transfer belt 8 (primary-transfer process), thus forming a four-color toner image on the intermediate transfer belt 8. Then, in each process cartridge 6, the drum cleaner 2 removes any toner remaining on the surface of the photoconductor 1 after the primary-transfer process. Further, the discharger removes electricity remaining on the surface of the photoconductor 1 after the cleaning process, and thus the surface of the photoconductor 1 is initialized as a preparation for subsequent image formation.

Referring to FIG. 2, the secondary-transfer nip is formed between the secondary-transfer backup roller 12 and a secondary-transfer roller 19 pressing against each other via the intermediate transfer belt 8. The four-color toner image formed on the intermediate transfer belt 8 is transferred onto the sheet P in the secondary-transfer nip (secondary-transfer process). Then, the cleaning unit 10 removes any toner remaining on the intermediate transfer belt 8 after the intermediate transfer belt 8 passes the secondary-transfer nip.

In the secondary-transfer nip, the intermediate transfer belt 8 and the secondary-transfer roller 19 rotate in the same direction, and the sheet P sandwiched between them is transported in a direction away from the pair of registration rollers 28. Then, the four-color toner image is fixed on the sheet P with heat and pressure while the sheet P passes between rollers of a fixing device 20.

Subsequently, the sheet P is discharged by a pair of discharge rollers 29 and stacked in the stack portion 30 formed on the upper surface of the printer 100.

Referring to FIG. 2, a configuration of the development device 5Y in the process cartridge 6Y is described below. The development device 5Y includes a development sleeve 51Y inside which a magnetic field generator (not shown) is provided and a doctor blade 52Y disposed facing a surface of the development sleeve 51Y. The development sleeve 51Y serves as a developer carrier that carries two-component developer consisting essentially of magnetic carrier particles and toner particles on its surface, and the doctor blade 52Y serves as a developer adjuster that adjusts the amount (layer thickness) of the developer carried on the development sleeve 51Y. The development device 5Y further includes a developer container 53Y, disposed upstream from the doctor blade 52Y in a direction in which the developer is transported by the development sleeve 51Y (hereinafter "developer conveyance direction"), for containing the developer that is not conveyed to an development area facing the photoconductor 1Y but is removed from the development sleeve 51Y by the doctor blade 52Y. Additionally, another developer container 54Y to which toner is supplied is provided adjacent to the developer container 53Y, and conveyance screws 55YA and 55YB are provided in the developer containers 53Y and 54Y, respectively.

Next, operation of the development device 5Y is described below with reference to FIG. 2.

In the development device 5Y, the developer contained in the developer container 53Y is carried on the development sleeve 51Y, forming a developer layer, and is transported to the development area as the development sleeve 51Y rotates. Toner (toner particles) is supplied to the developer container 53Y via the developer container 54Y as required to keep the toner concentration in the developer therein within a predetermined range. The toner particles mixed in the developer are electrically charged by friction with carrier particles therein. Then, the developer including the charged toner particles is supplied onto the circumferential surface of the development sleeve 51Y and carried thereon by the magnetic force exerted by magnetic poles of the magnetic field generator provided inside the development sleeve 51Y.

The developer carried on the development sleeve 51Y is transported in the direction indicated by arrow B shown in FIG. 2 as the development sleeve 51Y rotates. The developer carried on the development sleeve 51Y is transported to the development area facing the photoconductor 1Y after the doctor blade 52Y adjusts the amount of the developer carried on the development sleeve 51Y. In the development area, the toner particles in the developer are supplied to the electrostatic latent image formed on the photoconductor 1Y, thus developing it into a toner image. The developer remaining on the development sleeve 51Y is transported to an upstream portion in the developer container 53Y in the developer conveyance direction as the development sleeve 51Y further rotates. It is to be noted that, although two-component developer consisting essentially of magnetic carrier and toner is used in the present embodiment, alternatively, one-component developer consisting essentially of toner may be used.

It is to be noted that, in FIG. 2, reference characters 56, 57Y, 58Y, 41Y respectively represent a toner supply port, a controller, a toner concentration detector, and a drive motor for driving the toner conveyance device 40Y.

Figure 3:
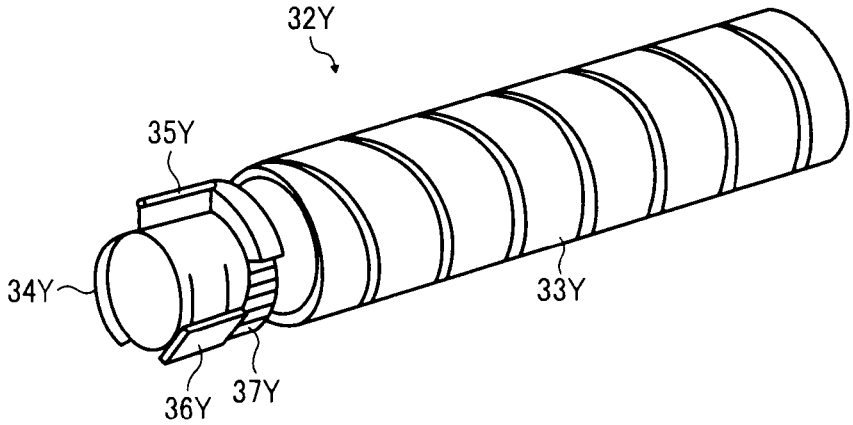
FIG. 3 is a perspective view of a toner bottle used in the image forming apparatus shown in FIG. 1.
Figure 4:
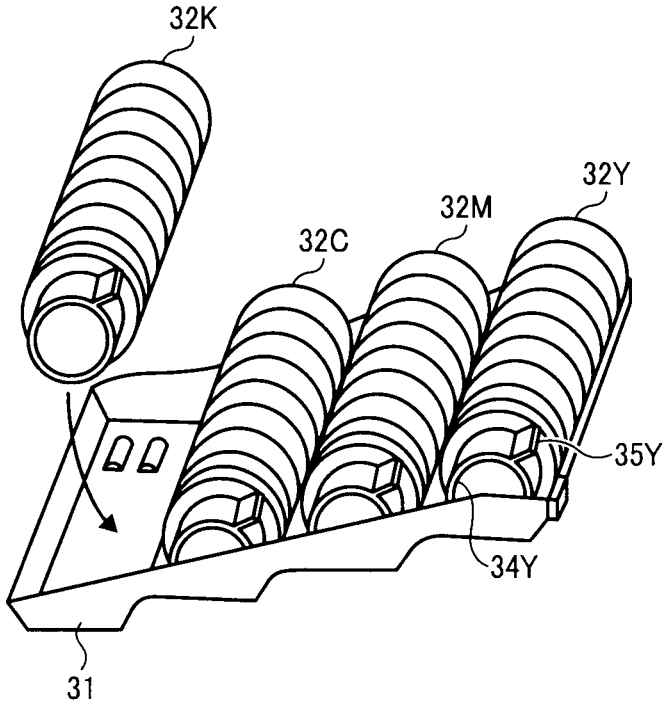
FIG. 4 is a perspective view of a bottle container of the image forming apparatus shown in FIG. 1, in which the toner bottle is housed.

FIG. 3 is a perspective view illustrating the toner bottle 32Y. FIG. 4 is a perspective view illustrating attachment of the toner bottle 32Y to the bottle container 31.

As shown in FIG. 3, the toner bottle 32Y includes a bottle body 33Y and a resin case or cap 34Y positioned on an end portion of the bottle body 33Y. Additionally, a handle 35Y is united to the resin case 34Y as a single unit, and a shutter 36Y for a toner discharge port, not shown, formed in the resin case 34Y is attached to the resin case 34Y. A gear 37Y that rotates together with the bottle body 33Y is provided on the end portion of the bottle body 33Y where the resin case 34Y is provided. To attach the toner bottle 32Y to the printer 100, users lifts the stack portion 30 (shown in FIG. 1) serving as an upper cover, thus exposing the bottle container 31.

Then, as shown in FIG. 4, the toner bottle 32Y is placed in the bottle container 31, after which the handle 35 is rotated. At that time, as the resin case 34Y united to the handle 35Y rotates, the shutter 36Y moves in a circumferential direction of the resin case 34Y, thus exposing the toner discharge port. Simultaneously, the resin case 34Y is connected to the bottle container 31 and fixed thereto.

By contrast, to remove the toner bottle 32Y from the printer 100, users rotate the handle 35Y in reverse, which disconnects the resin case 34Y from the bottle container 31. Simultaneously, the shutter 36Y moves to close the toner discharge port. In this state, the user can hold the handle 35Y and remove the toner bottle 32Y from the printer 100. Thus, attachment and removal of the toner bottle 32Y from the printer 100 can be performed from above, which facilitates replacement of the toner bottle 32Y.

Additionally, with the handle 35Y formed on the resin case 34Y, the toner bottle 32Y can be easily fixed to the bottle container 31 by rotating the resin case 34Y. It is to be noted that, when the toner bottle 32Y is not attached to the printer 100, the shutter 36Y does not open the toner discharge port even if the handle 35Y of the resin case 34Y is rotated. This configuration can prevent opening the shutter 36Y unintentionally in replacement of the toner bottle 32Y, and accordingly leakage of toner from the toner bottle 32Y can be prevented.

Next, toner conveyance is described below.

Figure 5:
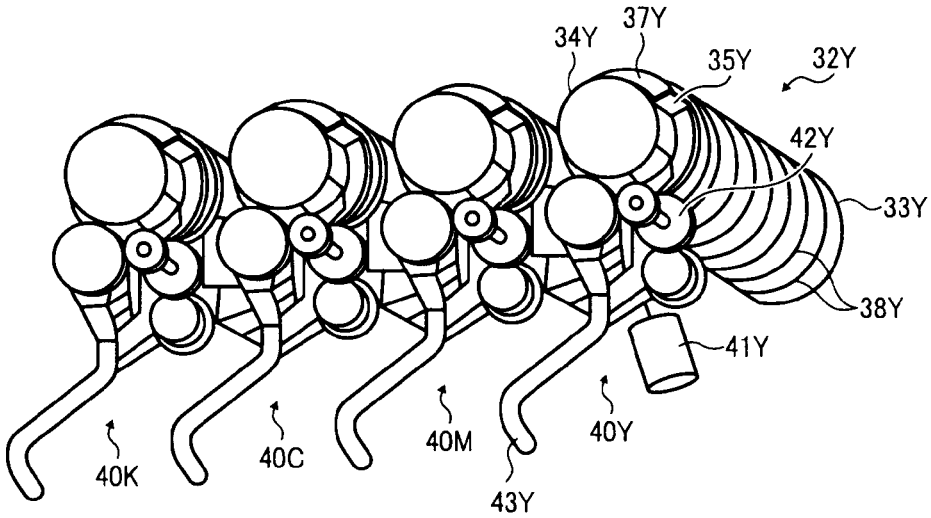
FIG. 5 is a perspective view of the toner bottle and a toner conveyance device connected thereto.
Figure 6:
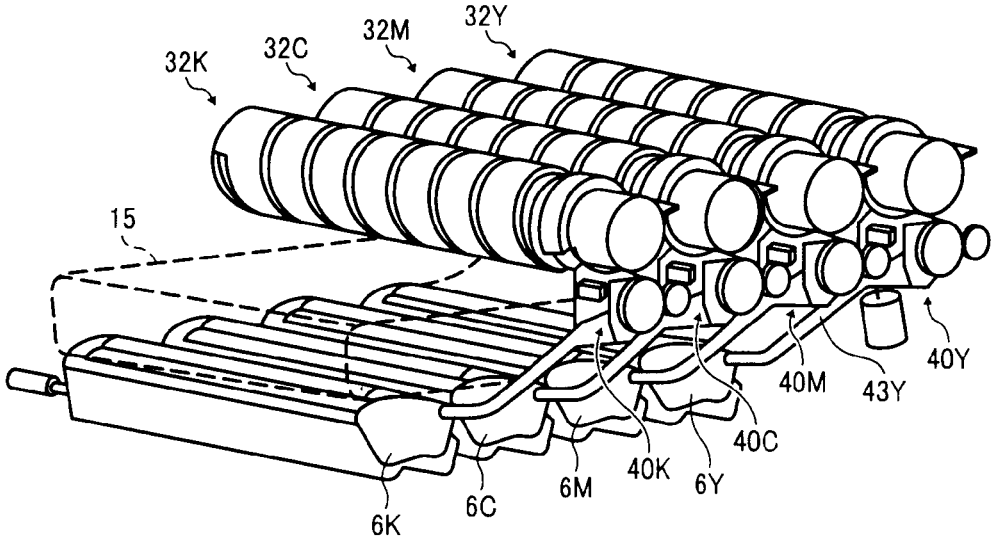
FIG. 6 is a perspective view of the toner conveyance device viewed from an angle different from that of FIG. 5.
Figure 7:
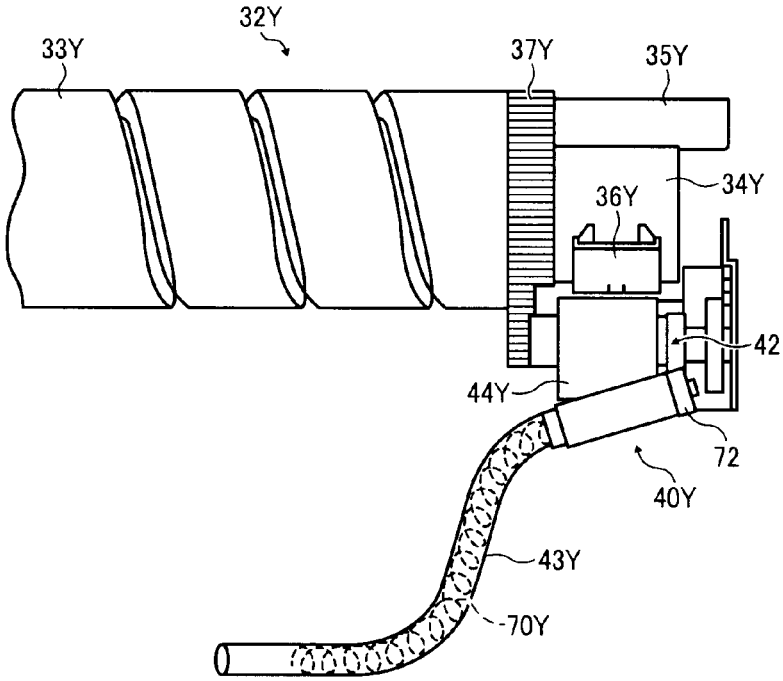
FIG. 7 is an enlarged diagram of the toner conveyance device.

FIG. 5 is a perspective view illustrating the toner bottles 32 and the toner conveyance devices 40. FIG. 6 is a perspective view illustrating the toner bottles 32, the intermediate transfer unit 15, and the toner conveyance devices 40 viewed from a different angle. FIG. 7 is an enlarged diagram of the toner conveyance device 40Y according to the present embodiment.

Referring to FIG. 5, the toner conveyance device 40Y includes the drive motor 41Y, a group of gears 42Y, and a conveyance pipe 43Y. A spiral groove 38Y for guiding toner is formed on an inner surface of the bottle body 33Y of each toner bottle 32Y.

As shown in FIG. 6, the toner conveyance devices 40 are positioned on the side of the intermediate transfer unit 15 in the printer 100. Using the toner conveyance devices 40 can eliminate the need of providing toner conveyance units in the respective process cartridges 6 or the respective toner bottles 32, and thus the process cartridges 6 or the toner bottles 32 can be more compact. Additionally, although, without the toner conveyance devices 40, limitations are posed on the design of the apparatus because it is preferred that the toner bottles 32 be disposed close to the respective process cartridges 6, the toner bottles 32 can be positioned away from the respective process cartridges 6 in the present embodiment, which increases flexibility in the design. Accordingly, the printer 100 can be more compact.

Further, the toner discharge port (not shown) of each toner bottle 32, each toner supply device 40, and the toner supply port 56 (shown in FIG. 2) formed in the developer container 54 of each development device 5 are positioned on the side of one end of the intermediate transfer unit 15 as shown in FIG. 6. With this configuration, a toner conveyance path through which toner is supplied from each toner conveyance device 40 to the corresponding development device 5 can be relatively short, which contributes to compactness of the printer 100 as well as prevention of clogging in toner conveyance.

It is to be noted that the toner conveyance devices 40Y, 40M, 40C, and 40K have a similar configuration and only the toner conveyance device 40Y for yellow toner is described below, thus omitting descriptions of the toner conveyance devices 40M, 40C, and 40K.

Referring to FIG. 7, a resin conveyance coil 70Y is provided inside the conveyance pipe 43Y to convey the toner downstream to the development device 5Y. One of the group of gears 42Y of the toner conveyance device 40Y engages the gear 37Y of the toner bottle 32Y, and, when the drive motor 41Y rotates, the bottle body 33Y rotates together with the gear 37Y of the toner bottle 32Y. The drive motor 41Y is rotated according to supply signals output from the controller 57Y when the toner concentration detector 58Y detects that the toner concentration in the developer container 54Y is insufficient.

As the bottle body 33Y thus rotates, toner thereinside is conveyed from the back side (on the left in FIG. 7) of the bottle body 33Y to the side of the resin case 34Y guided by the spiral groove 38Y, shown in FIG. 5, formed on the inner surface thereof. Then, the toner is discharged from the bottle body 33Y through the discharge port of the resin case 34Y and drops to a toner receiving compartment 44Y, serving as a powder container, of the toner conveyance device 40Y.

The toner receiving compartment 44Y communicates with the conveyance pipe 43Y. A gear 72 attached to a rotary shaft 71, shown in FIG. 8, penetrating the toner receiving compartment 44Y engages one of the group of gears 42Y, and the conveyance coil 70Y provided inside the conveyance pipe 43Y is connected to the rotary shaft 71. With this configuration, when the drive motor 41Y rotates, the bottle body 33Y and the conveyance coil 70Y in the conveyance pipe 43Y rotate simultaneously. As the conveyance coil 70Y thus rotates, the toner in the toner receiving compartment 44Y is conveyed through the conveyance pipe 43Y to the toner supply port 56 (shown in FIG. 2) formed in the developer container 54Y of the development device 5Y. Thus, the toner concentration in the development device 5Y is adjusted. It is to be noted that, instead of using the toner concentration detector 58Y, a photosensor or a charge-coupled device (CCD) camera may be used. More specifically, a reference image is formed on the photoconductor 1Y, the number of pixels of the reference image is measured with the photosensor or the CCD camera, and toner is supplied according to the detection result.

Next, toner conveyance by the toner conveyance device according to a first embodiment is described below.

Figure 8:
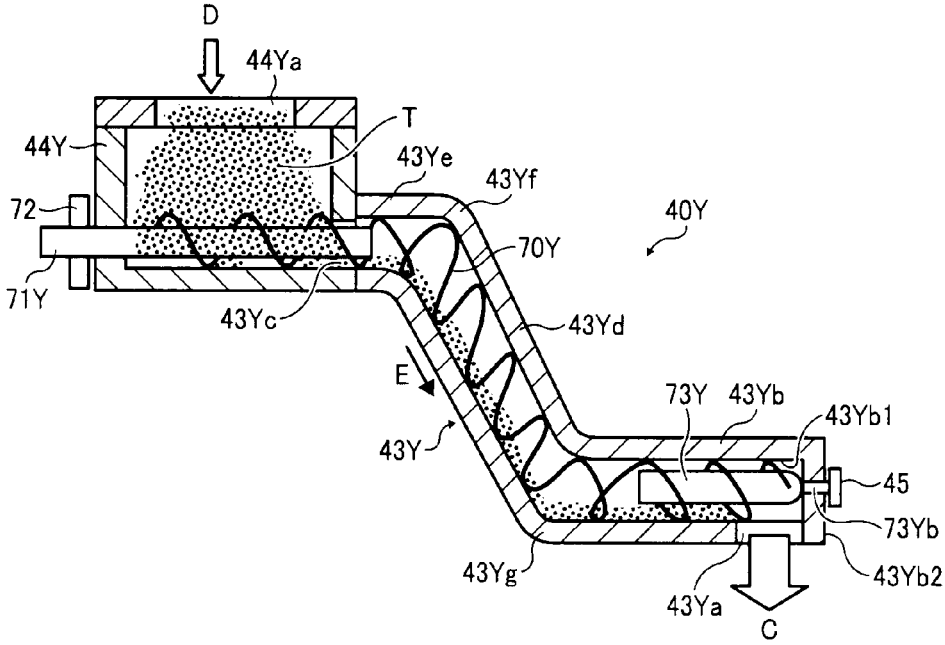
FIG. 8 is a cross-sectional diagram of the toner conveyance device according to a first embodiment.

FIG. 8 is a cross-sectional diagram of the toner conveyance device 40Y according to the first embodiment.

In the present embodiment, as shown in FIG. 8, an end portion of the conveyance coil 70Y, serving as a powder conveyance member, is connected to the rotary shaft 71Y, and the conveyance coil 70Y is in contact with an inner wall (inner circumferential surface) of the conveyance pipe 43Y. It is to be noted that "the conveyance coil 70Y is in contact with an inner wall of the conveyance pipe 43Y" allows a distance within a range of about 0.1 mm to 0.2 mm between the conveyance coil 70Y and the inner wall of the conveyance pipe 43Y. With this configuration, when the drive motor 41Y (shown in FIG. 5) rotates, the rotary shaft 71Y is rotated via the gear 72 engaging the gear 42Y (shown in FIG. 7). In this state, the conveyance coil 70Y can be rotated while being in contact with the inner wall of the conveyance pipe 43Y by rotating the rotary shaft 71Y via the gear 72Y that engages one of the group of gears 42Y.

Toner T is supplied from the toner bottle 32Y (shown in FIG. 7) in the direction indicated by arrow D shown in FIG. 8 to the toner receiving compartment 44Y through an opening 44Ya formed therein. To convey the toner T from the toner receiving compartment 44Y downward to the development device 5Y in the process cartridge 6Y (shown in FIG. 6), the drive motor 41Y is driven to generate force to move the toner T in the direction indicated by arrow E shown in FIG. 8 (hereinafter "toner conveyance direction") through the conveyance pipe 43Y. The toner T is supplied through an opening 43Ya formed in the conveyance pipe 43Y to the development device 5Y.

The conveyance coil 70Y is shaped to reduce its bending stress, and thus the conveyance pipe 70Y can rotate even when the conveyance pipe 43Y is bent. With this configuration, it is not necessary to extend the conveyance pipe 43Y straight, which enhances flexibility in layout of the components. Thus, the development device 5 can be more compact.

It is to be noted that, in some cases, conveyance members such as screws that have a shaft may be used instead of the conveyance coil 70Y in the conveyance path that is not straight. However, compared with such conveyance members having a shaft, coils can bend more easily. Therefore, repulsion to deformation of the conveyance coil 70Y rotating in a bent portion of the conveyance pipe 43Y can be smaller compared to conveyance members having a shaft. Consequently, load caused by friction between the conveyance coil 70Y and the inner wall of the conveyance pipe 43Y can be smaller compared to the case in which conveyance members having a shaft are used.

Referring to FIG. 8, in the first embodiment, the conveyance pipe 43Y includes a first conveyance portion 43Ye that communicates with the toner receiving compartment 44Y and a second conveyance portion 43Yd disposed downstream from the first conveyance portion 43Ye in the toner conveyance direction indicated by arrow E, connected to the first conveyance portion 43Ye via a first bent portion 43Yf. The second conveyance portion 43Yd extends downward toward the development device 5Y. The toner T is supplied from the toner receiving compartment 44Y to the first conveyance portion 43Ye through a supply port 43Yc formed therein. The first bent portion 43Yf is bent so that the horizontal gradient of the second conveyance portion 43Yd is greater than that of the first conveyance portion 43Ye.

The conveyance pipe 43Y further includes a third conveyance portion 43Yb disposed downstream from the second conveyance portion 43Yd in the toner conveyance direction indicated by arrow E, connected to the second conveyance portion 43Yd via a second bent portion 43Yg. The second bent portion 43Yg is bent so that the horizontal gradient of the third conveyance portion 43Yb is smaller than that of the second conveyance portion 43Yd. The toner T is supplied from the third conveyance portion 43Yb through the opening 43Yc formed therein in the direction indicated by arrow C shown in FIG. 8 to the development device 5Y. Additionally, a powder conveyance regulator (toner conveyance regulator) 73Y is provided inside the third conveyance portion 43Yb of the conveyance pipe 43Y to reduce the volume of space inside the conveyance pipe 43Y, thereby preventing a relatively large amount of toner accumulated in the conveyance pipe 43Y from rushing into the development device 5Y. In the present embodiment, the powder conveyance regulator 73Y is a flexible resin member shaped like a bar.

With the powder conveyance regulator 73Y, the amount of toner conveyed toward the development device 5Y can be adjusted.

Herein, for example, in multicolor image forming apparatuses, when fluidity (degree of agglomeration) of toner is different among different color toners or limitations in layout cause differences in the configuration (shape, length, etc.,) of the toner conveyance path for the respective color toners, the amount of toner supplied to the development device (hereinafter "toner supply amount") may be different among the different color toners or become insufficient because of such a powder conveyance regulator.

Moreover, in modification of existing image forming apparatuses to achieve higher image quality, if the type of toner used therein is changed, similar problems may arise due to differences in fluidity (degree of agglomeration) between the toner used in the existing apparatus and that used in the modified apparatus. In this case, it is preferable that a dedicated toner conveyance regulator be designed for each color, for each toner conveyance path, and for each modification of the apparatus.

In view of the foregoing, in the present embodiment, the shape in cross section of the conveyance regulator 73Y at the position facing the opening 43Ya is varied to adjust the amount of toner T conveyed to the opening 43Ya, through which the toner T is supplied from the conveyance pipe 43Y to the development device 5, by changing the position of the powder conveyance regulator 73Y at the position facing the opening 43Ya. In the present embodiment, the powder conveyance regulator 73Y is rotated to change its shape in cross section at that position.

Figure 9A:
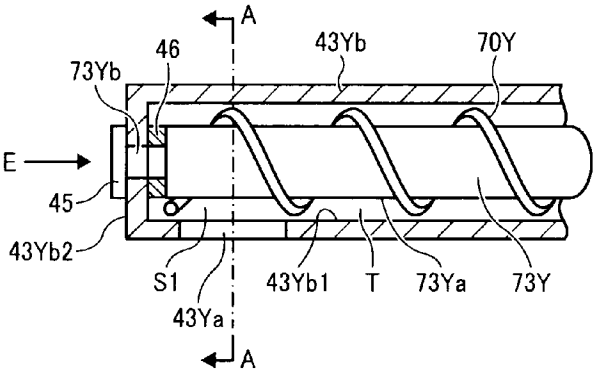
FIG. 9A is a cross-sectional view of a third conveyance portion along an axial longitudinal direction of an conveyance pipe when a shorter side of a powder conveyance regulator faces an opening (discharge port)
Figure 9B:
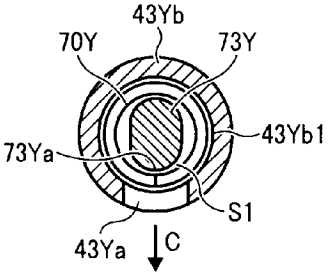
FIG. 9B is a cross-sectional view of the third conveyance portion shown in FIG. 9A along line A-A.
Figure 9C:
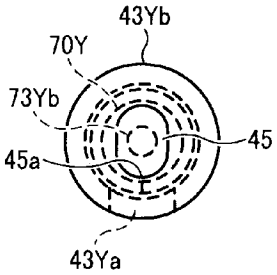
FIG. 9C is an end-on view of the third conveyance portion viewed in the direction indicated by arrow E in FIG. 9A.
Figure 9D:
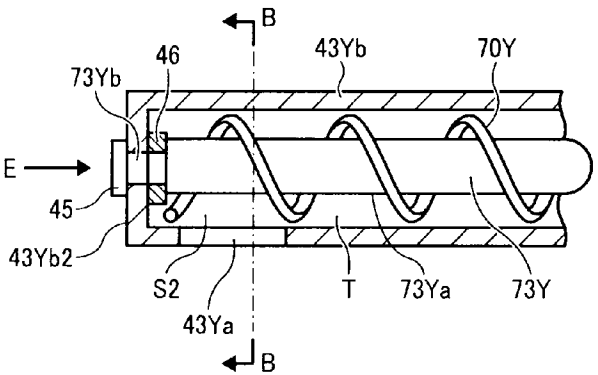
FIG. 9D is a cross-sectional view of the third conveyance portion along the axial direction of the conveyance pipe when a longer side of the powder conveyance regulator faces the opening.
Figure 9E:
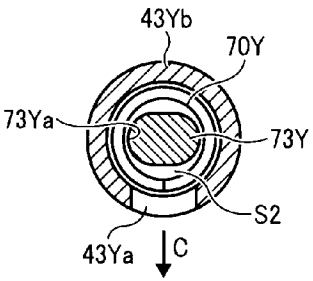
FIG. 9E is a cross-sectional view of the third conveyance portion shown in FIG. 9D along line B-B.
Figure 9F:
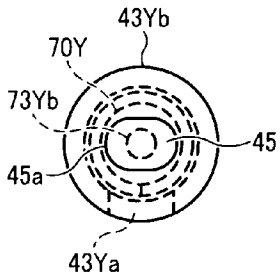
FIG. 9F is an end-on view of the third conveyance portion viewed in the direction indicated by arrow E in FIG. 9D.

Additionally, a handle 45Y is connected to a shaft 73Yb of the powder conveyance regulator 73Y, and reference character 43Yb1 shown in FIG. 8 represents an inner circumferential surface of the third conveyance portion 43Yb (conveyance pipe 43Y). FIGS. 9A through 9F schematically illustrate a configuration of the third conveyance portion 43Yb of the conveyance pipe 43 of the toner conveyance device 40Y according to the first embodiment. FIG. 9A is a cross-sectional view of the third conveyance portion 43Yb along the longitudinal direction of the conveyance pipe 43Y when a shorter side 73Ya of the substantially rectangular cross section of the powder conveyance regulator 73Y faces the opening 43Ya, that is, the shorter side 73Ya is perpendicular to the direction indicated by arrow C shown in FIG. 8. FIG. 9B is a cross-sectional view of the third conveyance portion 43Yb shown in FIG. 9A along line A-A, and FIG. 9C is an end-on view of the third conveyance portion 43Yb viewed in the direction indicated by arrow E in FIG. 9A. FIG. 9D is a cross-sectional view of the third conveyance portion 43Yb along the longitudinal direction of the conveyance pipe 43Y when a longer side of the cross section of the powder conveyance regulator 73Y faces the opening 43Ya, that is, the shorter side 73Ya parallels the direction indicated by arrow C shown in FIG. 8. FIG. 9E is a cross-sectional view of the third conveyance portion 43Yb shown in FIG. 9D along line B-B, and FIG. 9F is an end-on view of the third conveyance portion 43Yb viewed in the direction indicated by arrow E in FIG. 9D.

As shown in FIGS. 9A, 9B, 9D, and 9E, the powder conveyance regulator 73Y has a substantially rectangular or oval cross section perpendicular to an axial direction of the conveyance pipe 43Y. In other words, the powder conveyance regulator 73Y has a cross sectional shape having multiple radii of different lengths all in a single plane between a center of the shaft 73Yb and an outer circumference of the powder conveyance regulator 73Y. When the powder conveyance regulator 73Y is positioned in the conveyance pipe 43Y with the shorter side 73Ya facing the opening 43Ya as shown in FIGS. 9A and 9B, a cross sectional area S of a space (gap) formed above the opening 43Ya can be smaller (cross sectional area S1). Accordingly, the amount of toner discharged from the conveyance pipe 43Y through the opening 43Ya can be smaller.

By contrast, when the powder conveyance regulator 73Y is positioned in the conveyance pipe 43Y with the shorter side 73Ya disposed in parallel to the direction indicated by arrow C as shown in FIGS. 9D and 9E, the cross sectional area S of the space formed above the opening 43Ya can be larger (cross sectional area S2). Accordingly, the amount of toner discharged from the conveyance pipe 43Y through the opening 43Ya can be greater. The powder conveyance regulator 73Y can be rotated with the handle 45. With the rotation (positional change) of the powder conveyance regulator 73Y, the cross sectional area S of the space between the opening 43Ya (and the adjacent inner circumferential surface 43Yb1 of the conveyance pipe 43Y) and an outer surface of the powder conveyance regulator 73Y facing it can be adjusted for each color toner or for each modification of the apparatus.

In the present embodiment, as shown in FIGS. 9A and 9D, the shaft 73Yb of the powder conveyance regulator 73Y projects outside from an outer edge surface 43Yb2 of the third conveyance portion 43Yb of the conveyance pipe 43Y and is connected to the handle 45 that serves as a member to rotationally move the powder conveyance regulator 73Y. Therefore, rotating the handle 45 can change the shape in cross section of the powder conveyance regulator 73Y facing the opening 43Ya, and thus the cross sectional area S of the space can be varied. Consequently, the powder conveyance regulator 73Y are applicable to any of different color toners and to multiple toner conveyance paths shaped differently from each other and thus correspond to various configurations relatively easily with a lower cost.

Referring to FIGS. 9C and 9F, the handle 45 is shaped in correspondence with the shape in cross section of the powder conveyance regulator 73Y, with a shorter side 45*a* of the handle 45 aligned with that of the powder conveyance regulator 73Y, so that the rotational position of the shorter side 73Ya of the powder conveyance regulator 73Y can be checked from outside based on the rotational position of the handle 45. Thus, while checking the rotational position of the handle 45 from its external appearance, the rotational position of the powder conveyance regulator 73Y can be adjusted, and accordingly the toner supply amount can be adjusted finely for each color or for each toner conveyance path.

It is to be noted that, in FIGS. 9A and 9D, reference number 46 represents a seal member to prevent leakage of toner from the space between the conveyance pipe 43Y and the shaft 73Yb of the powder conveyance regulator 73Y. For example, the seal member 46 is constructed with foamed polyurethane or soft, elastic rubber and is fitted around the shaft 73Yb of the powder conveyance regulator 73Y, compressed with a predetermined or given force.

Figure 10A:
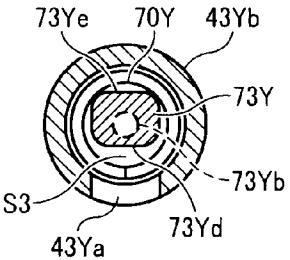
FIGS. 10A, 10B, and 10C are cross-sectional views that illustrate a variation of shape of the powder conveyance regulator.
Figure 10B:
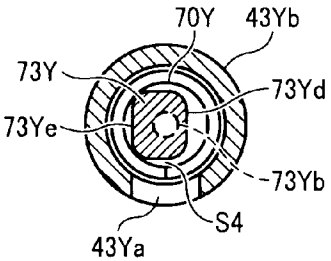
Figure 10C:
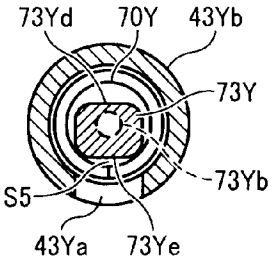

Additionally, the shape in cross section of the powder conveyance regulator 73Y can be selected from various different shapes. FIGS. 10A, 10B, and 10C illustrate a variation of the cross sectional shape of the powder conveyance regulator. In the variation shown in FIGS. 10A, 10B, and 10C, a shape in cross section of a powder conveyance regulator 73Y-1 has substantially parallel surfaces 73Yd and 73Ye whose radial distances from a center in its cross section are different. In this configuration, by rotating the powder conveyance regulator 73Y-1, for example, 90 degrees, the cross sectional area S of the space formed above the opening 43Ya can be changed among three different areas S3, S4, and S5. The cross sectional area S3 shown in FIG. 10A is greater than the cross sectional area S5 shown in FIG. 10C. The cross sectional area S4 shown in FIG. 10B is different from both the cross sectional areas S3 and S5 shown in FIGS. 10*a* and 10C and may be intermediate between them.

Figure 11A:
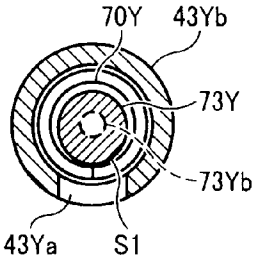
FIGS. 11A, 11B, and 11C are cross-sectional views that illustrate another variation of shape of the powder conveyance regulator.
Figure 11B:
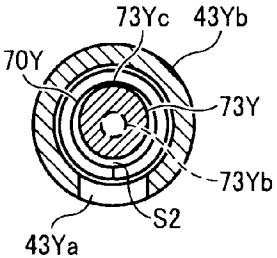
Figure 11C:
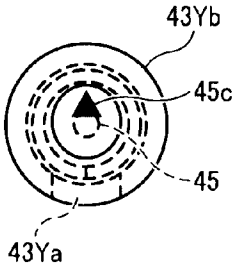
Figure 12:
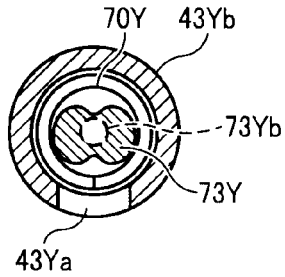
FIG. 12 is a cross-sectional view illustrating a third conveyance portion of a conveyance pipe according to a variation of the first embodiment.

FIGS. 11A, 11B, and 11C illustrate another variation of the powder conveyance regulator. FIGS. 11A and 11B are cross sectional views of a powder conveyance regulator 73Y-2 in which the cross sectional area of the space is smaller and greater, respectively, and FIG. 11C is an end-on view of the third conveyance portion 43Yb viewed in the direction indicated by arrow E shown in FIG. 9A. As shown in FIGS. 11A and 11B, the powder conveyance regulator 73Y-2 is shaped like a cylinder with its cross section having an irregular shape, like a cam, eccentric to the shaft 73Yb. The eccentric shape like a cam of the powder conveyance regulator 73Y-2 enables stepless adjustment of the cross sectional area S of the space formed between the opening 43Ya and the conveyance regulator 73Y-2 within a predetermined range including cross sectional areas S6 and S7 respectively shown in FIGS. 11A and 11B. Referring to FIG. 11C, in this configuration, a handle 45-2 for rotating the powder conveyance regulator 73Y-2 is provided with a mark (indicator) 45*c* disposed at a position aligned with a cam surface 73Yc, the length to which from the shaft 73Yb is longer. Therefore, the toner supply amount can be adjusted easily and reliably. FIG. 12 illustrates yet another variation of the powder conveyance regulator. As shown in FIG. 12, a powder conveyance regulator 73Y-3 has a gourd-shaped cross section, like two circles overlapped with each other. With this configuration, when the recessed surface faces the opening 43Ya, the cross sectional area of the space formed above the opening 43Ya can be larger than that in the configuration shown in FIG. 9E, in which the powder conveyance regulator 73Y is oval in cross section.

It is to be noted that, in the first embodiment and the variations thereof, the cross section of the powder conveyance regulator 73Y may be an identical or similar, and may be, for example, oval over the entire longitudinal length. Alternatively, only the portion of the powder conveyance regulator 73Y facing the opening 43Ya may have a predetermined shape.

Next, a toner conveyance device according to a second embodiment is described below with reference to FIGS. 13A, 13B, and 14.

Figure 13A:
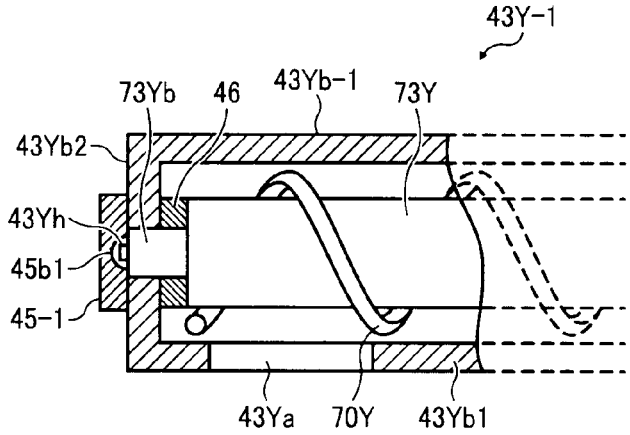
FIG. 13A is a cross-sectional diagram illustrating an interior of a third conveyance portion of a conveyance pipe according to a second embodiment, in which the cross sectional area of the space is maximum.
Figure 13B:
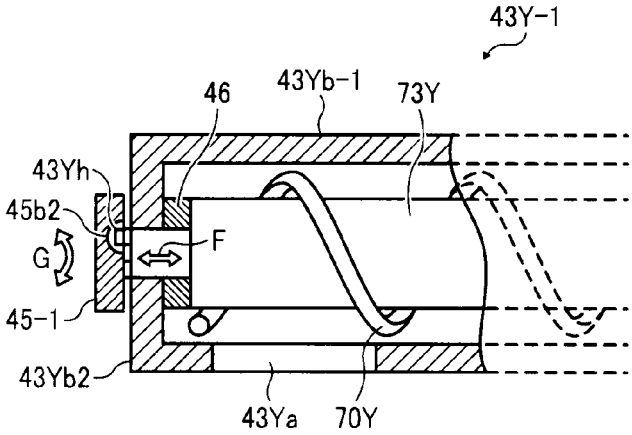
FIG. 13B is a cross-sectional diagram illustrating the interior of the third conveyance portion of the conveyance pipe shown in FIG. 13A, positioned at a different angle position.
Figure 14:
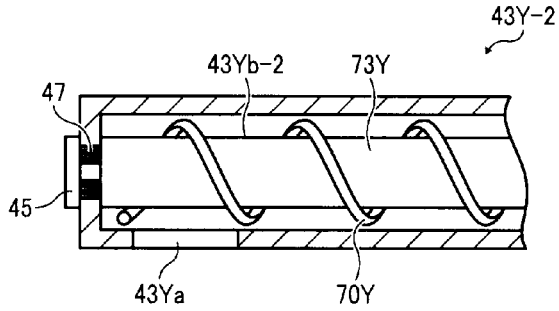
FIG. 14 is a cross-sectional view illustrating a third conveyance portion of a conveyance pipe according to a variation of the second embodiment.

FIGS. 13A and 13B are enlarged plane views illustrating a third conveyance portion 43Yb-1 of a conveyance pipe 43Y-1 of the toner conveyance device according to the second embodiment and correspond to FIGS. 9A and 9D, respectively. FIG. 14 illustrates a variation of the second embodiment, and an elastic ring is used instead of the seal member.

In the second embodiment, the powder conveyance regulator 73Y set at a given rotational position can be prevented from deviating therefrom and held at that position reliably.

In the embodiments of the present invention, the powder conveyance regulator 73Y is independent of the conveyance coil 70Y, and the rotation of the conveyance coil 70Y is less likely to directly rotate the powder conveyance regulator 73Y. However, it is still possible that the powder conveyance regulator 73Y might deviate from the set position as the conveyance coil 73Y rotates. Therefore, the second embodiment is designed to prevent the powder conveyance regulator 73Y from deviating from the set position as the conveyance coil 70Y rotates.

More specifically, as shown in FIGS. 13A and 14B, a projection 43Yh is formed on an outer edge surface 43Yb of the third conveyance portion 43Yb-1 of the conveyance pipe 43Y-1, and a first recessed portion 45*b*1 is formed on a back surface of a handle 45-1 to engage the projection 43Yh. The projection 43Yh is positioned corresponding to the shorter side 45*a* (shown in FIG. 9C) of the handle 45-1, and the powder conveyance regulator 73Y is fixed at a rotational position shown in FIG. 9B when the projection 43Yh is fitted in the first recessed portion 45*b*1. In this state, with rotation of the conveyance coil 70Y, the powder conveyance regulator 73Y does not rotate but can be kept at the set position.

To release the engagement between the projection 43Yh and the first recessed portion 45*b*1 of the handle 45-1, as shown in FIG. 13B, the handle 45-1 is pulled in the axial direction of the shaft 73Yb indicated by arrow F, against the elastic force exerted by the seal member 46, and thus the engagement can be released easily. Additionally, a second recessed portion 45*b*-2 is formed on the back side of the handle 45-1 at a rotational position shifted 90 degrees from the first recessed portion 45*b*1, that is, from the shorter side 45*a* (shown in FIG. 9C) of the handle 45-1. With this configuration, as shown in FIG. 13B, when the handle 45-1 is rotated in the direction indicated by arrow G shown in FIG. 13B, the powder conveyance regulator 73Y moves in the direction indicated by arrow F shown in FIG. 13B with the elastic force exerted by the seal member 46, and the projection 43Yh fits in the second recessed portion 45*b*2. Thus, the powder conveyance regulator 73Y is fixed at that position and does not rotate as the conveyance coil 70Y rotates.

As described above, in the second embodiment, engagement between the projection 43Yh formed on the edge surface 43Yb2 of the third conveyance portion 43Yh-1 and the recessed portion 45*b*1 or 45*b*2 formed in the back surface of the handle 45-1 fixes the powder conveyance regulator 73Y at the predetermined rotational position. In this case, referring to FIG. 14, the powder conveyance regulator 73Y can be held relatively tightly with an elastic ring 47 such as an O ring constructed of elastic rubber instead of the seal member 46. In this case, the powder conveyance regulator 73Y can be fixed at a desired rotational position and simultaneously leakage of toner can be prevented without providing the projection 43Yh and the recessed portions 45*b*1 and 45*b*2. This configuration is effective particularly for the configuration shown in FIGS. 11A through 11C in which the powder conveyance regulator 73Y-2 is shaped like an eccentric cam in cross section and the toner supply amount is varied steplessly.

It is to be noted that, although the cross sectional area of the space present above the opening 43Ya is changed by rotating the powder conveyance regulator 73Y in the above-described first and second embodiments, alternatively, the shape in cross section of the powder conveyance regulator 73Y may be different depending on the position in the axial direction so that the cross sectional area of the space can be changed by moving the powder conveyance regulator 73Y in the axial direction in the conveyance pipe 43Y. In this case, the handle 45 is moved in the direction indicated by arrow F shown in FIG. 13B, and the cross sectional area of the space present above the opening 43Ya is adjusted according to the distance by which the handle 45 is moved, that is, the movement amount of the handle 45.

Figure 15:
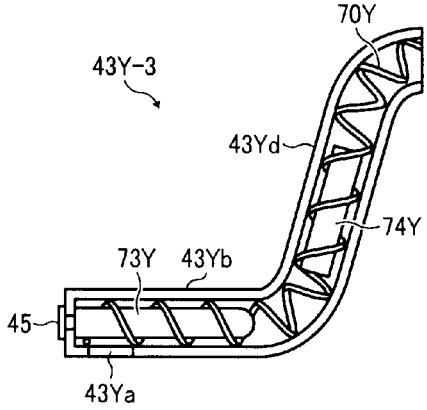
FIG. 15 is a cross-sectional view illustrating a third conveyance portion of a conveyance pipe according to a third embodiment.

Next, a toner conveyance device according to a third embodiment is described below with reference to FIGS. 15 and 16. FIG. 15 is a cross-sectional diagram of a conveyance pipe 43Y-3 of the toner conveyance device according to the third embodiment.

Figure 16:
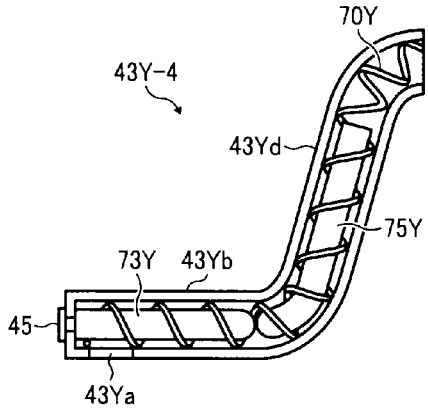
FIG. 16 is a cross-sectional view illustrating a third conveyance portion of a conveyance pipe according to a variation of the third embodiment.

FIG. 16 is a cross-sectional diagram of a conveyance pipe 43Y-4 of a toner conveyance device according to a variation of the third embodiment.

In the third embodiment, the toner conveyance device is designed for toner having a relatively higher degree of fluidity and inhibits uncontrolled flow of toner, that is, inhibits a large amount of toner from rushing through the opening 43Ya to the development device 5Y.

More specifically, as shown in FIG. 15, another powder conveyance regulator 74Y (second powder conveyance regulator) is provided in the conveyance pipe 43Y-3 and bonded to the conveyance coil 70Y with adhesive or the like at a center portion in the longitudinal direction of the conveyance coil 70Y. Thus, the powder conveyance regulator 74Y is rotatable together with the conveyance coil 70Y. In this configuration, occurrence of uncontrolled flow of toner can be prevented or reduced by reducing a space in the first conveyance portion 43Ye and the second conveyance portion 43Yd. With the powder conveyance regulator 74Y, the amount of toner conveyed toward the development device 5Y can be adjusted more suitably.

In the variation shown in FIG. 16, instead of the powder conveyance regulator 74Y bonded to the conveyance coil 70Y, a powder conveyance regulator 75Y is provided inside the conveyance pipe 43Y-4. The powder conveyance regulator 75Y is independent of the conveyance coil 70Y and is shaped in conformity with the inclined second conveyance portion 43Yd and the second bent portion 43Yg of the conveyance pipe 43Y-4. Providing the powder conveyance regulator 75Y can reduce the amount of air inside the conveyance pipe 43Y-4, thereby preventing excessive increases in the fluidity of the toner.

Next, a toner conveyance device according to a fourth embodiment is described below with reference to FIG. 17.

Figure 17:
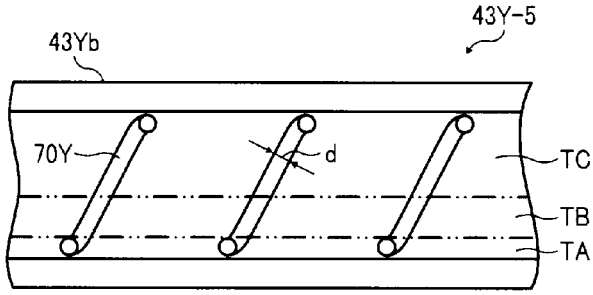
FIG. 17 is a cross-sectional view illustrating movement of toner in a conveyance pipe of a toner conveyance device according to a fourth embodiment.

FIG. 17 illustrates movement of toner in the third conveyance portion 43Yb of a conveyance pipe 43Y-5 of the toner conveyance device according to the fourth embodiment.

From observation of movement of toner in the third conveyance portion 43Yb of the conveyance pipe 43Y-5, it has been experimentally known that two different layers of toner are present therein when coils are used for transporting toner. More specifically, as shown in FIG. 17, the third conveyance portion 43Yb contains a toner layer TA that is moved directly by the conveyance coil 70A and a toner layer TB that is positioned inside the tone layer TA and moves following the movement of the toner layer TA. Moreover, a toner layer TC is present inside the toner layer TB and is formed with toner particles whose movement is delayed from that of the toner layer TA or toner particles that keep moving after the toner layer TA stops moving due to force of inertia or affected by the adjacent toner particles. The toner layer TC can be significantly affected by uncontrolled flow of toner.

Therefore, in the present embodiment, when the powder conveyance regulator 73Y is configured to restrict the movement of the toner layer TB, occurrence of uncontrolled flow of toner can be restricted. In particular, to prevent the above-described uncontrolled flow of toner, it is preferred that the across sectional area of the space present above the opening 43Ya be approximately less than three times a thickness (cross sectional area) d of the conveyance coil 70Y. Therefore, by configuring the powder conveyance regulator 73Y to have different multiple shapes in cross section to change the across sectional area of the space present above the opening 43Ya within a range less than three times the thickness d of the conveyance coil 70Y, adjustment of the toner supply amount as well as prevention of uncontrolled flow of toner can be attained.

It is to be noted that, although the description above concerns the conveyance device for powdered toner, alternatively, the powder conveyance device according to the above-described embodiments can be used for powered medicine or other types of powders. Numerous additional modifications and variations are possible in light of the above teachings. It is therefore to be understood that, within the scope of the appended claims, the disclosure of this patent specification may be practiced otherwise than as specifically described herein.

What is claimed is:

1. A powder conveyance device to transport powder to a destination, the powder conveyance device comprising:

a powder container for containing powder;

a conveyance pipe, extending downward from the powder container, the conveyance pipe including a first conveyance portion that communicates with the powder container and includes a supply port through which the powder enters in the conveyance pipe, a second conveyance portion extending downward, disposed downstream from the first conveyance portion in a powder conveyance direction in which the powder is transported from the powder container to the destination, a first bent portion connecting the first conveyance portion to the second conveyance portion, bent in a direction to increase a horizontal gradient of the second conveyance portion from a horizontal gradient of the first conveyance portion, a third conveyance portion that is disposed downstream from the second conveyance portion in the powder conveyance direction and includes a discharge port through which the powder is discharged from the conveyance pipe, and a second bent portion connecting the second conveyance portion to the third conveyance portion, bent in a direction to reduce a horizontal gradient of the third conveyance portion from the horizontal gradient of the second conveyance portion;

a powder conveyance member disposed inside the conveyance pipe, to transport the powder toward the destination downward;

a first powder regulator movably disposed adjacent to the discharge port, inside the third conveyance portion of the conveyance pipe, to restrict an amount of powder discharged through the discharge port by varying a cross sectional area of a space present between the discharge port formed in the third conveyance portion and an outer circumferential surface of the first powder regulator facing the discharge port with a change in position of the first powder regulator; and a handle to move the first powder regulator, disposed outside the conveyance pipe, wherein the first powder regulator is connected to the handle.

2. The powder conveyance device according to claim 1, wherein the handle is attached to an outer surface of the conveyance pipe.

3. The powder conveyance device according to claim 1, wherein the first powder regulator includes a rotary shaft about which the first powder regulator rotates, and the rotary shaft of the first powder regulator projects outside the third conveyance portion of the conveyance pipe and is connected to the handle.

4. The powder conveyance device according to claim 3, further comprising a seal member that is fitted around the rotary shaft of the first powder regulator and fills a gap between the first powder regulator and an inner surface of the third conveyance portion of the conveyance pipe.

5. The powder conveyance device according to claim 1, wherein the handle comprises a position indicator to indicate the position of the first powder regulator, and the cross sectional area of the space present between the discharge port formed in the third conveyance portion and the outer circumferential surface of the first powder regulator facing the discharge port is indicated by the position indicator.

6. The powder conveyance device according to claim 1, wherein the handle has a shape that conforms to a shape of the powder conveyance member, and the position of the first powder regulator is indicated by an angle position of the handle.

7. A powder conveyance device to transport powder to a destination, the powder conveyance device comprising:

a powder container for containing powder;

a conveyance pipe, extending downward from the powder container, the conveyance pipe including a first conveyance portion that communicates with the powder container and includes a supply port through which the powder enters in the conveyance pipe, a second conveyance portion extending downward, disposed downstream from the first conveyance portion in a powder conveyance direction in which the powder is transported from the powder container to the destination, a first bent portion connecting the first conveyance portion to the second conveyance portion, bent in a direction to increase a horizontal gradient of the second conveyance portion from a horizontal gradient of the first conveyance portion, a third conveyance portion that is disposed downstream from the second conveyance portion in the powder conveyance direction and includes a discharge port through which the powder is discharged from the conveyance pipe, and a second bent portion connecting the second conveyance portion to the third conveyance portion, bent in a direction to reduce a horizontal gradient of the third conveyance portion from the horizontal gradient of the second conveyance portion;

a powder conveyance member disposed inside the conveyance pipe, to transport the powder toward the destination downward; and a first powder regulator movably disposed adjacent to the discharge port, inside the third conveyance portion of the conveyance pipe, to restrict an amount of powder discharged through the discharge port by varying a cross sectional area of a space present between the discharge port formed in the third conveyance portion and an outer circumferential surface of the first powder regulator facing the discharge port with a change in position of the first powder regulator, wherein:

the powder conveyance member to transport the powder comprises a coil member, and the change in position of the first powder regulator varies the cross sectional area of the space present between the discharge port formed in the third conveyance portion and the outer circumferential surface of the first powder regulator facing the discharge port within a range less than three times a thickness of the coil member.

8. A powder conveyance device to transport powder to a destination, the powder conveyance device comprising:

a powder container for containing powder;

a conveyance pipe, extending downward from the powder container, the conveyance pipe including a first conveyance portion that communicates with the powder container and includes a supply port through which the powder enters in the conveyance pipe, a second conveyance portion extending downward, disposed downstream from the first conveyance portion in a powder conveyance direction in which the powder is transported from the powder container to the destination, a first bent portion connecting the first conveyance portion to the second conveyance portion, bent in a direction to increase a horizontal gradient of the second conveyance portion from a horizontal gradient of the first conveyance portion, a third conveyance portion that is disposed downstream from the second conveyance portion in the powder conveyance direction and includes a discharge port through which the powder is discharged from the conveyance pipe, and a second bent portion connecting the second conveyance portion to the third conveyance portion, bent in a direction to reduce a horizontal gradient of the third conveyance portion from the horizontal gradient of the second conveyance portion;

a powder conveyance member disposed inside the conveyance pipe, to transport the powder toward the destination downward; and a first powder regulator movably disposed adjacent to the discharge port, inside the third conveyance portion of the conveyance pipe, to restrict an amount of powder discharged through the discharge port by varying a cross sectional area of a space present between the discharge port formed in the third conveyance portion and an outer circumferential surface of the first powder regulator facing the discharge port with a change in position of the first powder regulator, wherein:

the first powder regulator includes a rotary shaft around which the first powder regulator rotates, and the first powder regulator has a shape in cross section having multiple radii of different lengths all in a single plane between a center of the rotary shaft and an outer circumference of the powder conveyance regulator.

9. The powder conveyance device according to claim 8, wherein the first powder regulator is rotatable about a rotary axis of the first powder regulator.

10. The powder conveyance device according to claim 8, wherein the powder transported by the powder conveyance device is toner used in an electrophotographic image forming apparatus.

11. The powder conveyance device according to claim 8, wherein the first powder regulator is rectangular or oval in cross section.

12. The powder conveyance device according to claim 8, wherein the first powder regulator has an eccentric shape in cross section.

13. The powder conveyance device according to claim 8, wherein the first powder regulator has a gourd-shape in cross section.

14. The powder conveyance device according to claim 8, further comprising a second powder regulator disposed upstream from the first powder regulator inside the conveyance pipe.

15. An image forming apparatus comprising:

the powder conveyance device of claim 8, an image carrier on which an electrostatic latent image is formed;

a development device to develop the latent image with toner into a toner image; and a toner bottle for containing toner.

* * * * *